United States Patent [19]

Sakakino et al.

[11] Patent Number: 4,851,627

[45] Date of Patent: Jul. 25, 1989

[54] COMPACT PRESSURE SENSITIVE SWITCH FOR USE IN DETECTING FLUID PRESSURE CHANGES

[75] Inventors: Takahiro Sakakino, Nagaokakyo; Masatsugu Yamashita, Kyoto; Sueaki Honda, Kurayoshi, all of Japan

[73] Assignee: Omron Tateisi Electronics Co., Kyoto, Japan

[21] Appl. No.: 219,852

[22] Filed: Jul. 13, 1988

Related U.S. Application Data

[63] Continuation of Ser. No. 104,570, Oct. 5, 1987, abandoned, which is a continuation of Ser. No. 782,461, Oct. 1, 1985, abandoned.

[30] Foreign Application Priority Data

| | | | |
|---|---|---|---|
| Oct. 2, 1984 | [JP] | Japan | 59-207390 |
| Oct. 2, 1984 | [JP] | Japan | 59-207391 |
| Oct. 2, 1984 | [JP] | Japan | 59-149983 |
| Oct. 4, 1984 | [JP] | Japan | 59-208580 |
| Oct. 23, 1984 | [JP] | Japan | 59-223467 |

[51] Int. Cl.[4] ..... H01H 35/32

[52] U.S. Cl. ..... 200/83 C; 200/83P; 337/320

[58] Field of Search ..... 337/318, 320; 92/34, 92/40, 43; 73/729; 307/118; 340/626; 200/83 P, 83 T, 83 C, 83 D, 83 J, 81 R, 302.1

[56] References Cited

U.S. PATENT DOCUMENTS

| | | | |
|---|---|---|---|
| 1,908,088 | 5/1933 | Warner | 200/83 C |
| 2,656,431 | 10/1953 | Bochan | 200/83 C |
| 3,185,796 | 5/1965 | Mamuja | 200/83 P |
| 3,356,803 | 12/1967 | Redmond | 200/83 |
| 3,364,320 | 1/1968 | Rhodes | 200/83 |
| 3,553,402 | 1/1971 | Hire | 200/83 P |
| 3,585,328 | 6/1971 | Fiore | 337/320 |
| 3,816,685 | 6/1974 | Fiore | 200/83 P |
| 3,953,692 | 4/1976 | Amano et al. | 200/83 |
| 3,996,054 | 12/1976 | Santemma et al. | 430/377 |
| 4,215,254 | 7/1980 | Ohki | 200/83 |
| 4,243,857 | 1/1981 | Reis | 200/83 C |
| 4,297,552 | 1/1980 | Lauritsen | 200/83 P |
| 4,410,776 | 10/1983 | Stoll | 200/83 P |
| 4,605,832 | 8/1986 | Koopman | 200/83 |
| 4,607,002 | 8/1986 | Nakayama et al. | 430/505 |
| 4,622,287 | 11/1986 | Umemoto et al. | 430/558 |
| 4,668,611 | 5/1987 | Nakamura | 430/546 |

FOREIGN PATENT DOCUMENTS

| | | | |
|---|---|---|---|
| 8332797 | 9/1984 | Fed. Rep. of Germany . | |
| 158446 | 8/1985 | Japan | 430/464 |

*Primary Examiner*—Gerald P. Tolin

*Attorney, Agent, or Firm*—Wegner & Bretschneider

[57] ABSTRACT

This pressure sensitive switch includes a bellows made of corrosion resistant material and with a hollow cylindrical body, which defines a pressure receiving surface on the outer surface of its one closed end portion, and with an open end which is fixedly secured to a fixed member in such a manner that the bellows may expand and contract in its longitudinal direction in response to small changes in the pressure difference between its interior space and the space outside it; a plunger mounted so as to reciprocate in response to the expansion and contraction of the bellows by being acted upon by the inner surface of the bottom portion of the bellows; and a switch assembly which is switched to and fro in response to the reciprocating motion of the plunger. This construction is compact and efficiently functional.

15 Claims, 5 Drawing Sheets

COMPACT PRESSURE SENSITIVE SWITCH FOR USE IN DETECTING FLUID PRESSURE CHANGES

This application is a continuation of U.S. application Ser. No. 104,570, filed Oct. 5, 1987, abandoned which is a continuation of U.S. application Ser. No. 782,461, filed Oct. 1, 1985, now abandoned.

BACKGROUND OF THE INVENTION

This invention relates to a pressure sensitive switch for detecting leakage of fluid based upon detection of pressure change in various fluids such as gas, liquid, and so on, and in particular relates to a pressure sensitive switch which has a wide range of applications to various fluids and allows very compact design.

Normally, a pressure sensitive switch of this type is so designed that pressure change of fluid is detected by way of a pressure receiving element which responds to such pressure change of fluid (see for instance Japanese Patent Laying Open Publication Serial No. 50-27078 and Japanese Patent Laying Open Publication Serial No. 56-120044).

However, a diaphragm made of thin rubber is used in such a pressure receiving element as described in the above patent applications, and because it does not have a sufficiently good anti corrosive property and is not properly and reliably air tight, the application of such a pressure switch is limited to areas where such heavy duty anti corrosion performance is not required Furthermore, if on the other hand, a diaphragm or a bellows made of metal is used, because of some structural complications when combining it with a contact mechanism, there is a difficulty in achieving a compact design for the switch.

It might be thought worth while to consider a method which reduces the thickness of a metallic bellows by etching, but according to such a method it is difficult to obtain uniformity in thickness, and, if the thickness is excessively reduced, pinholes may be created, and by reducing the thickness the pressure receiving portion becomes so soft that there will arise some fluctuations in the contact position and the pressure position in relation with the switching mechanism, thereby impairing its performance.

If an electrodeposited bellows which can be made extremely thin by the process of electroplating is used, fluctuations of the plate thickness of the bellows are reduced without forming any pinholes, and therefore it can be used as a highly sensitive pressure switch which can accurately detect very slight pressure changes.

However, conventionally, to the end of supporting the pressure receiving element, a support member which provides a mounting seat surface for the pressure receiving element is fixedly secured to the case by screws. Therefore, the support member has to be sufficiently thick for allowing the screws to be threaded thereinto, and therefore it has been difficult to make the design of such a switch compact enough. Furthermore, depending on the magnitude of the fastening force for the screws, and the fluctuations in the fastening force, the mounting precision may be impaired, and the operating properties of the switch may be adversely affected. Additionally, the need for female and male threads and the increased number of component parts and additional labor involved all have in the prior art contributed to some increase in cost.

Another problem that has arisen will now be outlined. As the pressure receiving element mentioned above, a bellows is widely used because it is superior in repeated stress performance and is highly durable, as per se known, and for mounting this bellows normally the open end of the bellows is for instance fitted into a fixed member.

Therefore, the open end of the bellows is provided for instance with a fitting portion consisting of a straight tubular portion extending in the axial direction to a substantial extent, and therefore the bellows tends to be long, thereby making it hard to design the pressure switch compact enough. Also, in mounting a bellows, it is difficult to position it in relation with the direction of receiving the pressure, and high dimensional precision is required between the bellows and the corresponding fixed member for proper fitting, thereby increasing its cost.

Another problem that has occurred with regard to the prior art is that the operation of such a bellows is typically without any hysteresis property. Therefore, the point at which the switch shifts from ON to OFF and the point at which the switch shifts from OFF to ON are always identical, and as a result there have been problems such as chattering, and other unstable actions may develop, and it is hard to distinguish between the time of abnormal pressure drop (caused by gas leakage and so on) and the time of restored state (the normal state).

Additionally, since conventionally the sheet spring making up the switch is made as a single sheet, the switching actuating force required therefor is as high as 400 to 600 grams, and it has been difficult to achieve a light switching action force.

SUMMARY OF THE INVENTION

Therefore, a primary object of this invention is to provide a pressure sensitive switch which is not limited in application to particular fluids, and which can be designed compactly in an efficient manner.

According to the present invention, this can be accomplished by a pressure sensitive switch, comprising: a bellows made of corrosion resistant material and with a hollow cylindrical body, which defines a pressure receiving surface on the outer surface of its one closed end portion, and with an open end which is fixedly secured to a fixed member in such a manner that the bellows may expand and contract in its longitudinal direction in response to small changes in the pressure difference between its interior space and the space outside it; a plunger mounted so as to reciprocate in response to the expansion and contraction of said bellows by being acted upon by the inner surface of said bottom portion of the bellows; and a switch assembly which is switched to and fro in response to the reciprocating motion of said plunger.

According to such a construction as per this invention, because an anticorrosive bellows is used as the pressure receiving element, this pressure sensitive switch is not limited in its application to particular non corrosive fluids, and accordingly the range of its applications can be readily expanded.

Furthermore, because the plunger is disposed in an internal space of the bellows which stretches and compresses in response to changes in fluid pressure, the internal space of the bellows is efficiently utilized, and this contributes to compact design of the pressure sensitive switch.

Additionally, by using a bellows which stretches and compresses in response to fluid pressure of a very high sensitive type made of extremely thin material, this switch can be used as a highly sensitive pressure sensitive switch which can detect a very slight change in pressure.

Another object of the present invention is to provide such a compact and highly sensitive pressure switch which does not sacrifice soft elasticity of its bellows.

This object is accomplished by a pressure sensitive switch as described above, further comprising a reinforcing plate made of corrosion resistant material fixedly secured to the outer surface of said bottom portion of said bellows.

According to this specialization of the present invention, by securely attaching the reinforcement plate to the pressure receiving portion of the bellows, the mechanical strength of the thinly formed pressure receiving portion can be increased, and, because the circumferential surface of the bellows which is to stretch and to compress is not increased in rigidity, the elasticity of the bellows is not impaired, thereby providing a highly sensitive pressure switch which has both high mechanical strength and high elasticity.

Furthermore, since the plunger comes into contact with the inner surface of the pressure receiving portion, which is reinforced, the reinforcement plate which is provided on the outer surface of the pressure receiving portion does not affect the stroke of the plunger, even if here are some fluctuations in the plate thickness of the reinforcement plate, for example if it has been subjected to some thermal effect during the process of securely attaching it to the pressure receiving portion, whereby a highly precise and stable performance of the pressure switch is obtained.

Another object of this invention is to provide a pressure switch which is made compact, high in performance, and low in cost, by omitting such a fixedly securing means consisting of screws.

This object is accomplished, according to a specialization of the present invention, by a pressure sensitive switch as first described above, further comprising a casing into which is integrally molded a retaining plate, said retaining plate serving as a seat surface for the open end portion of said bellows which is fixedly mounted.

According to this specialized aspect of the present invention, because the support plate for mounting the bellows is integrally formed with the case by insert molding, the prior art type of fixed securing means consisting of screws can be omitted, and therefore the female threaded portion becomes unnecessary, with the result that the support plate may be extremely thin and the switch may be designed in a very compact manner. Furthermore, because of the avoidance of any uneven fastening action due to the use of screws, the chance of dimensional errors in assembly is reduced, and stable operating properties of the switch can be obtained. Furthermore, because of elimination of component parts such as male threads and female threads and reduction in manufacturing steps, reduction in manufacturing cost is assured.

According to a particular further specialization of the present invention, other problems identified above are resolved by a pressure switch as first described above, said open end portion of said bellows being formed as a flanged portion, and further comprising: a pressure receiving flange, having substantially the same outer diameter as said flange of said bellows; and a retaining plate, having substantially the same outer diameter as said flange of said bellows; said flange of said bellows being sandwiched between said pressure receiving flange and said retaining plate, and the outer portions of said members being welded together; said bellows being supported from a fixed member by said welded together portions of said bellows, said pressure receiving flange, and said retaining plate.

According to this aspect of the present invention, by forming a mounting flange to the periphery of the open end of the bellows, a fitting portion extending axially from the bellows is not required, and therefore the axial length thereof is reduced, whereby compact design of the switch is assured. And by sandwiching the flange of the bellows between the pressure receiving flange and the retaining plate which are provided with the same diameter as the flange of the bellows from above and below and connecting the overlaid portions on the outer circumference, for instance by laser welding, the bellows is accurately positioned between the pressure receiving flange and the retaining plate, and since the upper and lower surfaces are supported by seat surfaces the bellows is fixed in a stable manner. And since the three layers are overlaid and welded together at this overlaid and welded portion, its sealing performance is high and the assembly is simplified.

Another object of the present invention is to provide a pressure sensitive switch which is free from chattering and can reliably distinguish between the abnormal pressure dropped state and restored state, and which is highly reliable, by adding a hysteresis property to the switch assembly incorporated in the pressure switch. This object is in addition to obtaining other advantages such as low actuating force, high durability, and high sensitivity.

This aspect of the present invention is achieved by a pressure sensitive switch as first described above, said switch assembly comprising: a projection; a pair of contacts; a third contact; a movable piece the one end of which is engaged to said projection and the other end of which is movable between said contacts; a biasing spring assembly which gives said movable piece snap action and hysteresis action; said biasing spring assembly comprising a first spring member cut out from said movable piece and a second separate spring member; a free end of said first spring member being engaged to an engagement groove formed in one side of said third contact; said second spring member being interposed, in an arcuately curved and stressed state, between an engagement groove formed on the other side of said third contact and an engagement projection formed on said movable piece; an end of said plunger being engaged to said movable piece.

According to this particular specialization of the present invention, because a hysteresis property is added to the movable piece by the biasing spring piece, the operational conditions at which the switch assembly moves over from the ON state to the OFF state, and from the OFF state to the ON state, are brought to be different, whereby chattering and other unstable actions are eliminated, and the distinction between the abnormal pressure dropping state and the restored state becomes clearer thanks to this hysteresis property, with the result that the reliability of the switch can be improved.

Additionally, because the biasing spring piece is made of two pieces, it can be actuated with a very small force such as 6 to 10 grams, and the durability of the switch may be improved.

BRIEF DESCRIPTION OF THE DRAWINGS

The present invention will now be shown and described with regard to the preferred embodiment thereof, and in conjunction with the appended drawings. It should be clearly understood, however, that the description of the embodiment, and the drawings, are all of them intended only to be illustrative of the present invention, since the scope of the present invention is to be delimited solely by the legitimate and proper scope of the accompanying claims. In the figures, like reference numerals denote the same part in the various figures thereof, references to physical orientation are to be taken only as referring to the orientation of the figures on the drawing paper, unless otherwise qualified.

DESCRIPTION OF THE PREFERRED EMBODIMENT

Figure 1:
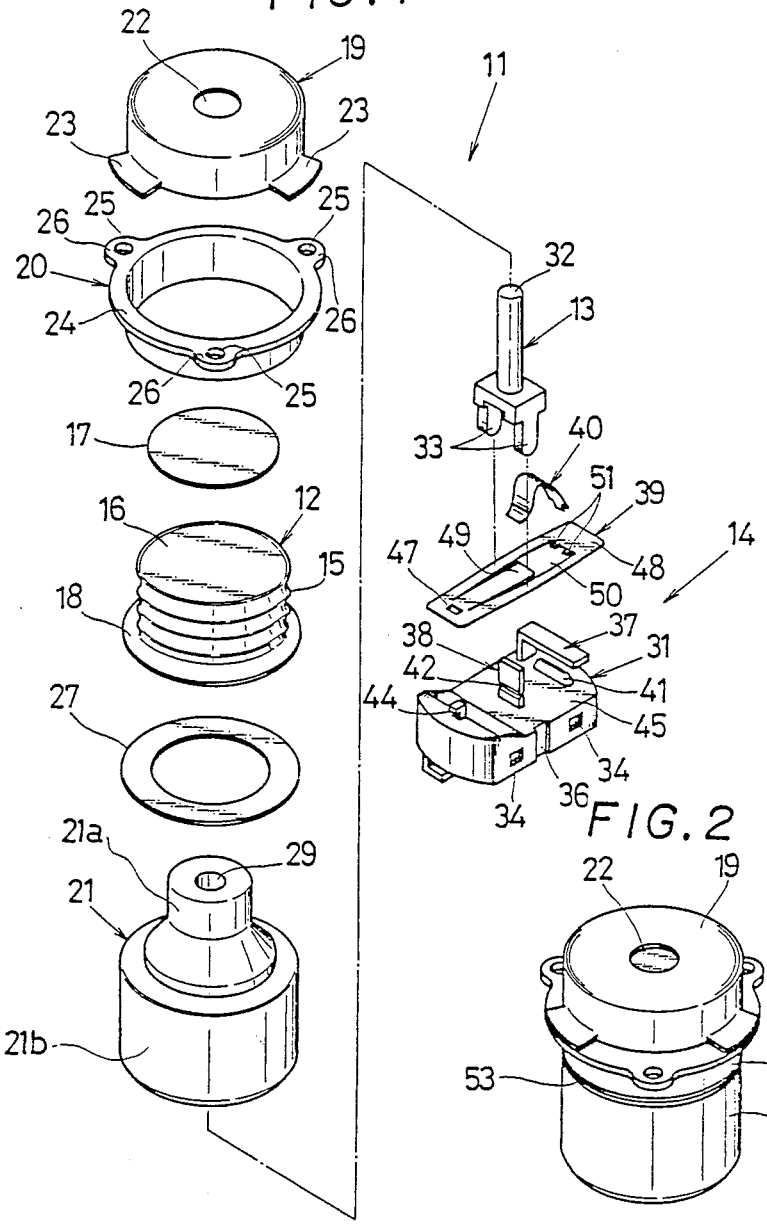
FIG. 1 is a forward exploded view of the preferred embodiment of sensitive switch of the present invention.
Figure 2:
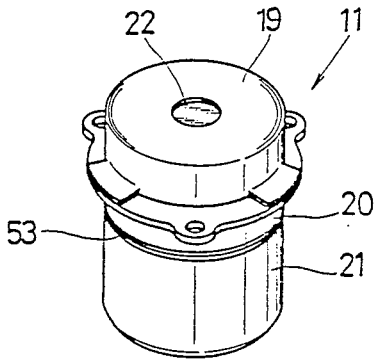
FIG. 2 said preferred embodiment in perspective view in its assembled state.
Figure 3:
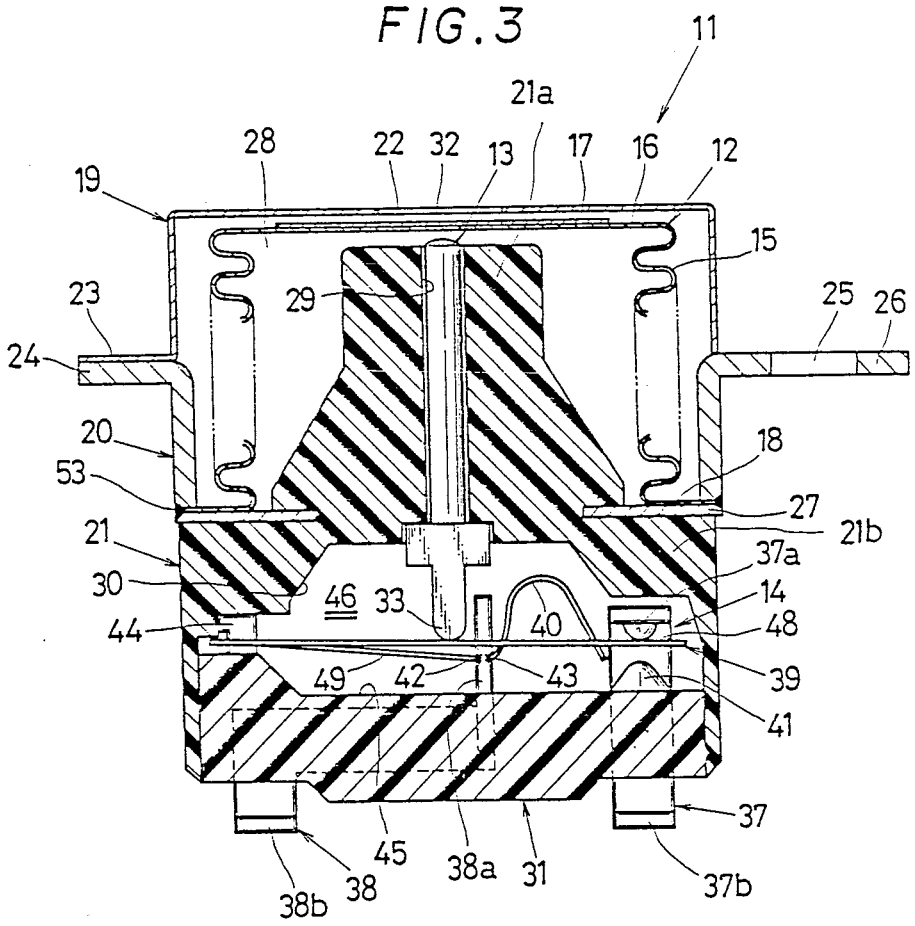
FIG. 3 cross sectional view of said preferred embodiment, taken in a plane which includes its central longitudinal axis.

Now the present invention will be described in terms of its preferred embodiment and with reference to the appended drawings. In FIG. 1 there is shown an exploded view of the preferred embodiment of the pressure sensitive switch of the present invention, and in FIG. 2 said preferred embodiment is shown in perspective view in its assembled state, while FIG. 3 shows a cross sectional view of the pressure sensitive switch taken in a plane which includes its central longitudinal axis. This pressure sensitive switch is adapted for being used for detecting leaks of gas such as public utility gas, liquid petroleum gas (LPG), and so on, and comprises as principal members: a bellows 12 which opens and closes according to variations in gas pressure, thus elongating and shrinking with regard to its longitudinal dimension; a plunger 13 which undergoes vertical motion in response to such elongation and shrinking of the bellows 12; and an action switch 14 which opens and closes in response to such vertical motion of the plunger 13.

The bellows 12 is formed, in a manner which is per se known, as a hollow cylindrical member with one end open and one end closed, and with a cylindrical side surface which is formed with circumferentially extending wrinkles 15 spaced apart at approximately equal intervals along the axial direction thereof, so that said bellows 12 can easily elongate and shrink in its longitudinal direction as a response to a change in ambient pressure. This bellows 12 may be made by electrodeposition (electroplating) of an appropriate metal which has high anti corrosion property or corrosion resistance; and the thickness of its outer shell is very small, being of the order of 15 to 20 microns.

The upper end surface 16 of the bellows 12 as seen in FIG. 1, i.e. the closed end thereof, is substantially flat and defines a pressure receiving surface 16, and a thin and stiff reinforcing plate member 17 made of a metal which has high anti corrosion property or corrosion resistance is fixedly attached to said pressure receiving surface 16. Thereby, the pressure receiving surface 16 is sufficiently reinforced as not to deform substantially as the ambient gas pressure varies. And around the lower end of the bellows 12 as seen in FIG. 1, i.e. around its open end, there is provided a radially outwardly extending flange 18, which is fixed to the periphery of the lower end of the thin wall material of the cylindrical body of the bellows 12 by a welding process which will be described hereinafter.

A protective cap member 19 is fixed over the bellows member 18 to cover it when the pressure sensitive switch is assembled, and a mounting ring member 20 is fixed to this protective cap member 19 and surrounds the bellows member 18. These two members together constitute a pressure receiving unit for the pressure sensitive switch. Further, to the lower side of the assembly of these members as seen in FIG. 3 there is fitted a casing member 21 for the switch as a whole. This casing member 21 supports the bellows member 18 and the cap member 19 and the mounting ring member 20, and a conical protruding portion thereof extends into the inner space defined within the bellows 12 as particularly shown in FIG. 3. In detail, the casing member 21 is formed in a stepped shape, with an upper portion **21*a* as seen in FIG. 3 of relatively small diameter and with a lower portion 21*b* of relatively large diameter. This small diameter upper portion 21*a* is fitted into the internal space 28 of the bellows 12, and is formed with a central axially extending hole 29 within which the plunger member 13, to be detailed hereinbelow, is fitted. This construction is particularly provided for minimizing the axial dimension of the pressure sensitive switch as a whole, and is effective for saving space. And the large diameter lower portion 21*b* of the casing member 21 is attached at its upper periphery in the figures to the lower periphery of the mounting ring member 20, while the upper periphery in the figures of said mounting ring member 20 is attached to the lower periphery of the protective cap member 19**.

The protective cap member 19 is shaped as a hollow cylindrical body with an open lower end and a closed upper end, so that it surrounds the upper part of the peripheral surface of the bellows member 12. And the central portion of said closed upper end of said protective cap member 19 is formed with a hole 22 of relatively small diameter for admitting gas, while further the periphery of said open lower end of said cap member 19 is formed with three (in the shown preferred embodiment) radially projecting tag portions 23 for mounting the cap member 19. And the mounting ring member 20 is formed as a cylindrical ring member with a flange 24 provided at its axially upper end in the figures for securing the tag portions 23 of the cap member 19 thereto, and this flange 24 further is formed with a plurality (three in the shown preferred embodiment) of radially projecting mounting extensions 26 formed with holes 25 therein, for mounting the switch as a whole to a piece of equipment, which is not particularly shown in the drawings. Since the bellows member 12, the metallic reinforcing plate member 17, the protective cap 19, and the mounting ring member 20 come into prolonged and intimate contact with the gas whose pressure is to be sensed which is introduced into the space defined between the outer surface of the bellows member 12 and the inner surfaces of the protective cap member 19 and of the ring member 20, they are preferably manufactured from an corrosion resistant and air tight material such as stainless steel, nickel alloy, or the like.

Figure 5:
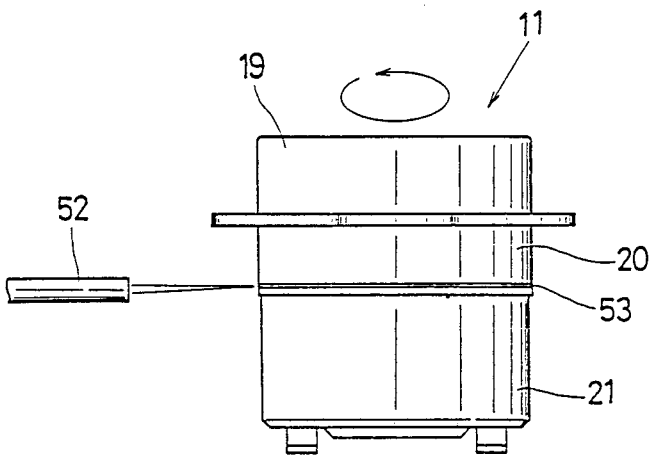
FIG. 5 is a side view of a welding process using laser welding for attaching a bellows member of this preferred embodiment to a switch assembly.

The flange 18 of the bellows member 12 is held and clamped between the lower periphery of the mounting ring member 20 and a retaining plate 27 which will be described hereinafter, and is fixedly welded in an air tight manner into this situation. In more detail, as illustrated in FIG. 5 which is a side view of the process, the axially lower end of the mounting ring member 20, the flange 18 of the bellows member 12, and the outer circumference of the retaining plate 27 are layered together, sandwiching the flange 18 between the pressure receiving ring member 20 and the retaining plate 27, and the outer circumference of this layered together sandwich is welded together while it is rotated, as for example by using a laser welding apparatus 52. As a result, this welded portion is accurately relatively positioned, and is sealed in an air tight manner without any possibility of gas leakage therethrough in either direction; and this may be done as described above in an efficient manner.

Figure 6:
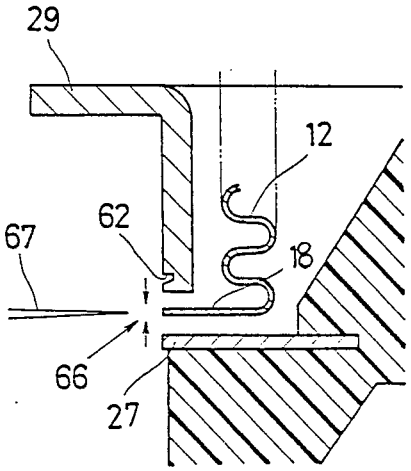
FIG. 6 is a magnified sectional view of the welded portion in a variant embodiment.

In FIG. 6, a variation of this technique is illustrated. In this variation, the efficiency of the performance of the laser welding process is improved. A circumferential groove 62 is formed around the bottom circumferential edge portion of the mounting ring member 20 which is itself relatively stout and strong and thick, adjacent to the portion thereof which is to be welded, and this circumferential groove 62 hinders the dispersion of the welding heat provided by the laser flash 67 of the laser welding apparatus. Thereby, during the welding process, this heat is kept locally concentrated in the outer circumferential portion 66 of the overlaid sandwich, consisting of the outer periphery of the axially lower end of the mounting ring member 20, the outer periphery of the flange 18 of the bellows member 12, and the outer periphery of the retaining plate 27, and accordingly a higher temperature is attained for a longer time, whereby the effectiveness of the welding process is further improved.

The retaining plate 27 is an annular disk member which is made of a metallic material such as stainless steel which is suitable for laser welding, and the inner periphery of this annular disk member 27 is fitted into a slot formed in the aforementioned step shape of the casing member 21 of the pressure sensitive switch by insert molding, at the time of molding of said casing member 21, so as to be fixedly attached thereto. When it is thus insert molded, the upper surface of the outer periphery of the retaining plate 27 is exposed, and thereafter as described above this upper surface is used as a seat surface for seating the lower surface of the flange 18.

As mentioned above, the axially extending hole 29 is formed through the smaller diameter upper portion **21*a* of the casing member 21 of the switch, and a cavity 30 is formed in the lower surface of said casing member 21, i.e. on the free end surface of the larger diameter lower portion 21*b* thereof. A base 31 is mounted in the outer end of this cavity 30 at the lower end of the casing member 21, and carries on its upper side a switch assembly 14 which will be described hereinafter, which is thus housed within said cavity 30. Particularly, engagement depressions 34 formed on the opposite sides of said base 31 are engaged with engagement projections 35 formed on the sides of the cavity 30, and thereby provide a solid and secure engagement between the base 31 and the casing member 21. And the reference numeral 36 denotes a hole for communicating the internal space within said cavity 30, defined above the switch assembly 14** in the figures, with the ambient atmosphere.

The plunger member 13 which as stated above is fitted into the plunger hole 29 is slidably mounted therein, and its upper end in the figures is provided with a contact surface 32 which projects from the upper end surface of the casing member 21 and contacts the inner side of the pressure receiving surface 16 of the bellows member 12. Further, the lower end of the plunger member 13 is provided with a bifurcated pair of engagement projections 33 which extend downwards for pushing on the actuating element of the switch assembly 14. Thus, according to changes in the pressure of the gas supplied to the interior of the assembly of the bellows member 12 and the protective cap member 19 etc. through the hole 22, or more exactly according to changes in the difference between the pressure of said gas and ambient atmospheric pressure, the axial length of the bellows member 12 changes, and this causes the plunger 13 to undergo axial motion, to actuate the switch assembly 14.

Figure 4:
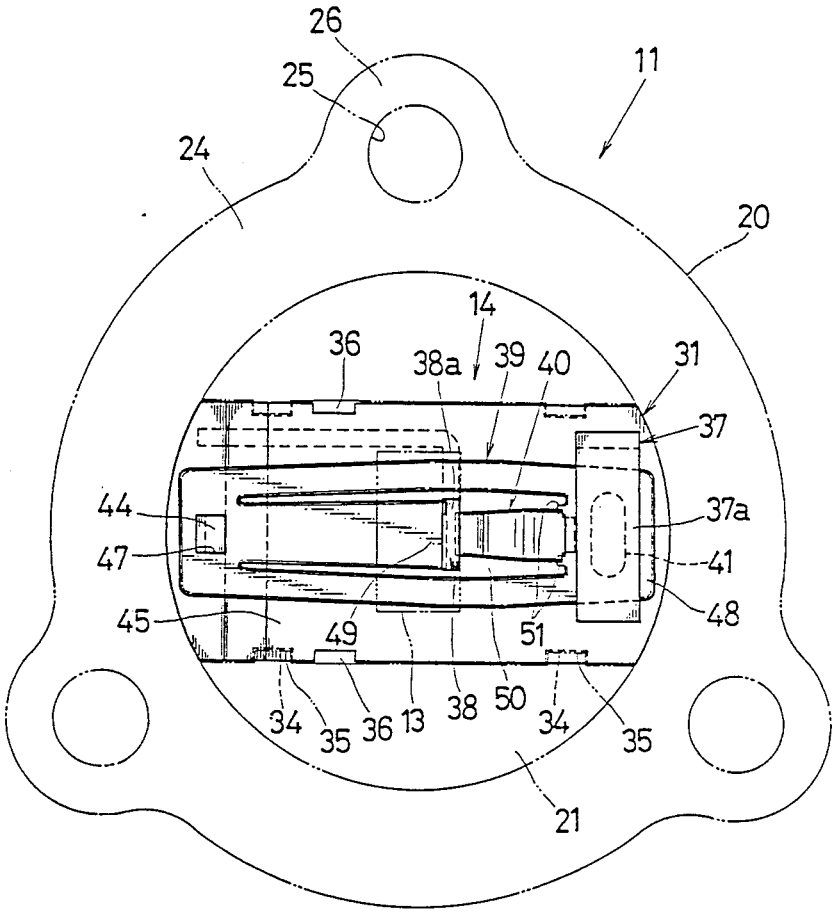
FIG. 4 shows a switch assembly of said preferred embodiment in plan view as fitted into a cavity of a casing member on the upper side of a base.

This switch assembly 14 will now be described in detail; it is shown in FIG. 4 in a plan view as fitted into the cavity 30 of the casing member 21, on the upper side of the base 31. This switch assembly 14 includes a first fixed terminal 37, a second fixed terminal 38, a sheet spring main body 39 which is mounted at its fixed end and whose free end is located between the fixed contact terminal 37 and another OFF contact terminal 41, and an arcuately curved biasing spring member 40 and a straight fixed piece 49, the cooperation of said arcuately curved spring member 40 and said straight fixed piece 49 providing a snap action or hysteresis action for the switching process of the switch as will be described shortly. Both of the fixed terminals 37 and 38 are insert molded to fit through the base 31 at the same time as forming the base 31, and their upper ends project from the upper surface of said base 31 and constitute first and second fixed contacts **37*a* and 38*a* respectively, while their lower ends 37*b* and 38*b* respectively protrude downwards from the lower surface of said base 31**, on the outside of the pressure sensitive switch, for constituting external terminal portions for being connected to an electrical circuit which is to be switched by this pressure sensitive switch.

The first fixed contact **37*a* is shaped as an inverted letter "L", and extends parallel to the upper surface of the base 31 for a certain distance. A non conductive OFF contact piece 41 is fixed to said upper surface of the base 31 as opposing said first fixed contact 37*a* with a certain gap being left therebetween. And the second fixed contact 38*a* projects from the central portion of the upper surface of the base 31 as a plate member extending vertically from the point of view of the drawings, and on the opposite sides of this plate shaped contact member 38*a* at a certain intermediate point thereup there are inscribed engagement grooves 42 and 43 for engaging with members which will be described shortly. And a sheet spring engagement projection 44** projects from the other side of the upper surface of the base 31, remote from the contact member 38*a*.

Referring particularly to FIG. 3, these fixed contacts 37*a* and 38*a* project from a lower stepped portion 45 of the base 31, and, when the base 31 is mounted into the casing member 21, these fixed contacts 37*a* and 38*a* come to be located in an inner space 46 which is defined by the lower surface depression 30 of the case member 21 and the lower step portion 45 of the base 31.

A sheet spring main body member 39 is engaged to the sheet spring engagement projection 44 by an engagement opening 41 thereof, while the other end of said sheet spring main body member 39 is formed as a movable piece 48 which is located between the first fixed contact member 37*a* and the OFF contact 41. A fixed piece 49 is fixedly secured to (by being integrally formed with) a middle position on the sheet spring main body member 39 at its one end, while its other end remains free. Thus, by engagement of the free end of said fixed piece 49 with a one 42 of the sheet spring engagement grooves formed on the second fixed contact member 38*a*, the sheet spring main body member 39 is fixedly supported on the base 31. The fixed piece 49 is provided within a centrally cut out and generally rectangular opening 50 formed in the sheet spring main body member 39 by cutting it out, and one end of the arcuately curved biasing spring piece 40 is engaged to engagement projections 51 which project out from the short side edge of the opening 50 adjacent to the first fixed contact member 37*a*, while the other end of the arcuately curved biasing spring member 40 is engaged to the other sheet spring engagement groove 43 formed on the second fixed contact member 38*a*, with the arcuately curved biasing spring member 40 kept thereby in a slightly compressed state. Thereby, the free end 48 of the sheet spring main body 39 is kept as biased against the first fixed contact member 37 by the biasing force exerted by said biasing spring member 40. And the two engagement projections 33 of the plunger member 13 are engaged to the respective sides of the sheet spring main body member 39 in a depressable manner. In other words, the biasing spring member 39 is split into its free end portion 48 and the fixed piece 49, which also acts to some extent as a spring.

Thus, when this pressure sensitive switch is mounted to the body of some piece of equipment, not particularly shown in the figures, and a supply of gas is communicated via the hole 22 to the interior of the assembly of the bellows member 12 and the protective cap member 19 etc., said supply of gas typically being at a pressure substantially above ambient atmospheric pressure, the bellows member 12 will be axially lengthened to a certain extent according to the difference between the pressure of this supply of gas and ambient atmospheric pressure, as compared to the axial extent of said bellows member 12 when the pressure inside it is equal to the pressure outside it which can be taken as its standard length, and this amount of axial extension of the bellows member 12 causes the plunger member 13 to be axially positioned in a relatively downwardly displaced position in the plunger hole 29, which causes the projections 33 on the lower end thereof to press downwardly on the lower sheet spring main body 39, thus causing the movable piece 48 to be displaced from the first fixed contact member 37*a*, thus causing the first and second external terminal portions 37*b* and 38*b* to be electrically disconnected from one another, thus causing the pressure sensitive switch to be in the OFF state. Thus, this pressure sensitive switch is of the normally closed type.

On the other hand, if and when a leakage of gas develops and the pressure of this gas supply via the hole 22 to the interior of the assembly of the bellows member 12 and the protective cap member 19 etc. drops, the length of the bellows member 12 becomes much closer to its standard length, and this allows the plunger member 13 to move to a relatively upwardly displaced position in the plunger hole 29, which causes the projections 33 on the lower end thereof no longer to press downwardly on the lower sheet spring main body 39, thus allowing the movable piece 48 to move upward so that it comes to be in contact with the first fixed contact member 37*a*, thus causing the first and second external terminal portions 37*b* and 38*b* to be electrically connected to one another, thus causing the pressure sensitive switch to be in the ON state. This switching of the pressure sensitive switch can be utilized by the equipment main body for providing a proper warning of such gas leakage, such as for example for flashing of a lamp or for initiation of the production of an appropriate warning sound.

Figure 7:
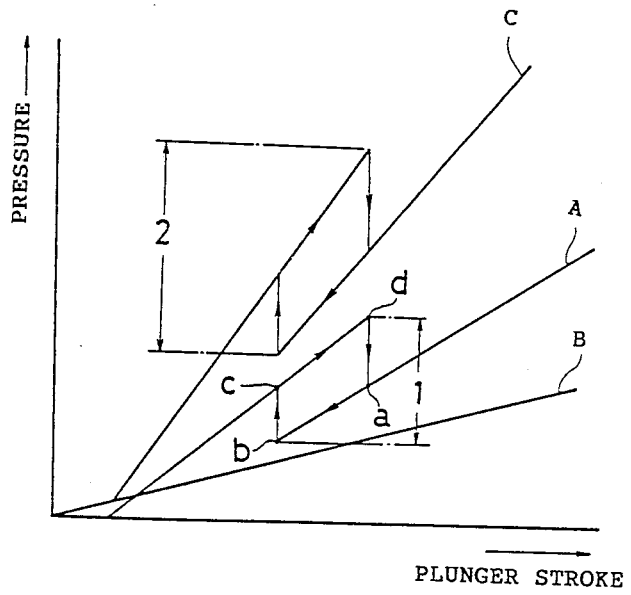
FIG. 7 is an operating property chart for the preferred embodiment of the switch of the present invention, for explaining its hysteresis characteristics.

Since the fixed piece 49 and the biasing spring member 40 give a snapping action and a hysteresis property to the switch assembly 14, when the pressure in the interior of the assembly of the bellows member 12 and the protective cap member 19 etc. has declined from that shown by the point a (normal pressure level) shown in the performance chart of FIG. 7 to that shown by the point b (abnormal low pressure level) due to gas leakage, the movable piece 48 immediately is brought away from the OFF contact 41 and contacts the ON contact 37*a* under the spring force of the fixed piece 49 and the biasing spring member 40.

And when the gas pressure has risen from that shown by the point c (abnormal low pressure level) shown in FIG. 7 up to that shown by the point d (normal pressure level), for instance by taking measures against the gas leakage, the movable piece 48 immediately leaves away from the ON contact 37*a* and comes into contact with the OFF contact 41 under the spring force of the biasing spring pieces 40 and 40', so that the switch assembly 14 returns to the normal state.

In other words, the action switch 14 turns ON and OFF along the property curve shown by (A) in FIG. 7, and has the property of hysteresis, as indicated by h1 in FIG. 7. And since the bellows member 12 stretches and compresses along the property curve shown by (B) in FIG. 5, the overall property of the pressure sensitive switch becomes as indicated by (C) in FIG. 7, and it thus has a sufficiently effective hysteresis property, as shown by h2 in FIG. 5, whereby unstable performance characteristics such as chattering of the switch assembly 14 are eliminated, and this hysteresis property produces the effect of making the distinction clear between the abnormal pressure dropped state and the restored state, with the result that the reliability of the indication provided by the switch may be improved.

Additionally, since the spring member is split into the fixed piece 49 and the biasing spring member 46, as compared to a conventional structure made of a single plate spring member, a lighter actuating force is required and the durability of the switch may be improved.

According to such a construction as per this invention, because an anticorrosive bellows is used as the pressure receiving element, this pressure sensitive switch is not limited in its application to particular non corrosive fluids, and accordingly the range of its applications can be readily expanded.

Furthermore, because the plunger is disposed in an internal space of the bellows which stretches and compresses in response to changes in fluid pressure, the internal space of the bellows is efficiently utilized, and this contributes to compact design of the pressure sensitive switch.

And, since the bellows is made of an extremely thin high sensitive type of material which stretches and compresses in response to changes in the pressure of the fluid, this pressure sensitive switch can be used as a highly sensitive pressure sensitive switch which can detect very slight pressure changes.

Although the present invention has been shown and described with reference to the particular preferred embodiment thereof and with reference to the accompanying drawings, it should be clearly understood that these have been furnished for the purposes of explanation and exemplification only, and are not to be relied upon for defining the scope of the present invention, and the protection desired to be offered by Letters Patent, since various alterations could be made to the details of any particular embodiment without departing from the spirit of the present invention. Accordingly, the scope of the present invention, and the protection desired to be offered by Letters Patent, are to be defined, not by any of the perhaps purely fortuitous details of the shown embodiment, or of the drawings, but solely by the legitimate and proper scope of the accompanying claims, which follow.

What is claimed is:

1. A pressure sensitive switch comprising:

(a) a longitudinally-compressible bellows, having an interior and an exterior, a corrosion-resistant coating on its exterior surface, a hollow, cylindrical body disposed about a longitudinal axis, a closed end portion of said body defining an outer, pressure-receiving surface and an inner surface, and an open end portion of said body fixed to a casing having no relatively movable parts, such that said bellows compresses and expands responding to changes in the exterior/interior pressure differential;

(b) a plunger comprising an axially-movable shaft, which is mounted in said interior transversely to said inner surface, and an end of which engages said inner surface on compression of said bellows;

(c) a switch assembly in said casing that actuates from a first to a second mode and means for actuating said switch assembly in a delayed, snapping manner upon axial movement of said plunger caused by compression of said bellows, which means returns said switch assembly to the first mode in a delayed, snapping manner upon subsequent expansion of said bellows; and (d) said casing for said switch assembly having an upper fixed portion projecting therefrom within said cylindrical body in the direction of said inner surface and providing a channel within which said axially-movable shaft is disposed.

2. A pressure sensitive switch according to claim 1, further comprising a reinforcing plate made of corrosion resistant material fixed to said outer, pressure receiving surface.

3. A pressure sensitive switch according to claim 1, wherein said corrosion-resistant coating is electroplated metal.

4. A pressure sensitive switch comprising:

(a) a longitudinally-compressible bellows, having an interior and an exterior, a corrosion-resistant coating on its exterior surface, a hollow, cylindrical body disposed about a longitudinal axis, a closed end portion of said body defining an outer, pressure-receiving surface and an inner surface, and an open end portion of said body fixed to a support, said open end portion of said bellows being integrally formed as a flanged portion along said open end portion, such that said bellows compresses and expands responding to changes in the exterior/interior pressure differential;

(b) a plunger comprising an axially-movable shaft, which is mounted in said interior transversely to said inner surface, and an end of which engages said inner surface on compression of said bellows;

(c) a switch assembly that actuates from a first to a second mode and means for actuating said switch assembly in a delayed, snapping manner upon axial movement of said plunger caused by compression of said bellows, which means returns said switch assembly to the first mode in a delayed, snapping manner upon subsequent expansion of said bellows; and (d) a pressure receiving ring having substantially the same diameter as said flanged portion of said bellows and a retaining plate having substantially the same outer diameter as said flanged portion of said bellows, said flanged portion of said bellows being sandwiched between said pressure receiving ring and said retaining plate, and said flanged portion, said pressure receiving ring, and said retaining plate being fixed to said support.

5. A pressure sensitive switch comprising:

(a) a longitudinally-compressible bellows, having an interior and an exterior, a corrosion-resistant coating on its exterior surface, a hollow, cylindrical body disposed about a longitudinal axis, a closed end portion of said body defining an outer, pressure-receiving surface and an inner surface, and an open end portion of said body fixed to a support, such that said bellows compresses and expands responding to changes in the exterior/interior pressure differential;

(b) a plunger comprising an axially-movable shaft, which is mounted in said interior transversely to said inner surface, and an end of which engages said inner surface on compression of said bellows; and (c) a switch assembly that actuates from a first to a second mode and means for actuating said switch assembly in a delayed, snapping manner upon axial movement of said plunger caused by compression of said bellows, which means returns said switch assembly to the first mode in a delayed, snapping manner upon subsequent expansion of said bellows, and comprising a base;

a projection projecting from said base;

a pair of contacts;

a third contact;

a movable piece, one end of which is engaged to said projection and the other end of which is movable with respect to said contacts;

a biasing spring assembly which gives said movable piece snap action and hysteresis action;

said biasing spring assembly comprising a first spring member cut out from said movable piece and a second separate spring member;

a free end of said first spring member being engaged to an engagement groove formed in one side of said third contact;

said second spring member being interposed, in an arcuately curved and stressed state, between an engagement groove formed on the other side of said third contact and an engagement projection formed on said movable piece; and an end of said plunger being coupled to said movable piece.

6. A pressure sensitive switch according to claim 5, further comprising a casing for said switch assembly having an upper portion projecting therefrom within said cylindrical body in the direction of said inner surface and providing a channel within which said axially-movable shaft is disposed.

7. A pressure sensitive switch according to claim 6, wherein said corrosion-resistant coating is electroplated metal.

8. A pressure sensitive switch according to claim 5, wherein said movable piece has an opening formed therein, and said end of said plunger is bifurcated and is coupled to said movable piece at opposing sides of said opening.

9. A pressure sensitive switch according to claim 5, wherein said switch assembly is normally closed.

10. A pressure sensitive switch comprising:

(a) a longitudinally-compressible bellows, having an interior and an exterior, a corrosion-resistant coating on its exterior surface, a hollow, cylindrical body disposed about a longitudinal axis, a closed end portion of said body defining an outer, pressure-receiving surface and an inner surface, and an open end portion of said body fixed to a casing, said open end portion of said bellows being integrally formed as a flanged portion along said end open portion, such that said bellows compresses and expands responding to changes in the exterior/interior pressure differential;

(b) a plunger comprising an axially-movable shaft, which is mounted in said interior transversely to said inner surface, and an end of which engages said inner surface on compression of said bellows;

(c) a switch assembly in said casing that actuates from a first to a second mode and means for actuating said switch assembly in a delayed, snapping manner upon axial movement of said plunger caused by compression of said bellows, which means returns said switch assembly to the first mode in a delayed, snapping manner upon subsequent expansion of said bellows;

(d) said casing for said switch assembly having an upper portion projecting therefrom within said cylindrical body in the direction of said inner surface and providing a channel within which said axially-movable shaft is disposed;

(e) a pressure receiving ring, having substantially the same diameter as said flanged portion of said bellows; and (f) a retaining plate, having substantially the same outer diameter as said flanged portion of said bellows;

wherein said flanged portion of said bellows is sandwiched between said pressure receiving ring and said retaining plate, and said flanged portion, said pressure receiving ring, and said retaining plate are fixed to said casing.

11. A pressure sensitive switch according to claim 10, wherein said retaining plate is integrally fixed to said casing.

12. A pressure sensitive switch comprising:

(a) a casing having no relatively movable parts;

(b) a longitudinally-compressible bellows, having an interior and an exterior, a corrosion-resistant exterior surface, a hollow, cylindrical body disposed about a longitudinal axis, a closed end portion of said body defining an outer, pressure-receiving surface and an inner surface, and an open end portion of said body fixed to said casing, such that said bellows compresses and expands responding to changes in the exterior/interior pressure differential;

(c) a plunger comprising an axially-movable shaft, which is mounted in said interior transversely to said inner surface, and an end of which engages said inner surface on compression of said bellows; and (d) a switch assembly that actuates from a first to a second mode and means for actuating said switch assembly in a delayed, snapping manner upon axial movement of said plunger caused by compression of said bellows, which means returns said switch assembly to the first mode in a delayed, snapping manner upon subsequent expansion of said bellows;

(e) wherein said casing for said switch assembly has an upper fixed portion projecting therefrom within said cylindrical body in the direction of said inner surface and providing a channel within which said axially-movable shaft is disposed.

13. A pressure sensitive switch comprising:

(a) a longitudinally-compressible bellows, having an interior and an exterior, a corrosion-resistant exterior surface, a hollow, cylindrical body disposed about a longitudinal axis, a closed end portion of said body defining an outer, pressure-receiving surface and an inner surface, and an open end portion of said body fixed to a support, said open end portion of said bellows being integrally formed as a flanged portion along said open end portion, such that said bellows compresses and expands responding to changes in the exterior/interior pressure differential;

(b) a plunger comprising an axially-movable shaft, which is mounted in said interior transversely to said interior surface, and an end of which engages said inner surface on compression of said bellows;

(c) a switch assembly that actuates from a first to a second mode and means for actuating said switch assembly in a delayed, snapping manner upon axial movement of said plunger caused by compression of said bellows, which means returns said switch assembly to the first mode in a delayed, snapping manner upon subsequent expansion of said bellows; and (d) a pressure receiving ring having substantially the same diameter as said flanged portion of said bellows and a retaining plate having substantially the same outer diameter as said flanged portion of said bellows, said flanged portion of said bellows being sandwiched between said pressure receiving ring and said retaining plate, and said flanged portion, said pressure receiving ring, and said retaining plate being fixed to said support.

14. A pressure sensitive switch comprising:

(a) a longitudinally-compressible bellows, having an interior and an exterior, a corrosion-resistant exterior surface, a hollow, cylindrical body disposed about a longitudinal axis, a closed end portion of said body defining an outer, pressure-receiving surface and an inner surface, and an open end portion of said body fixed to a support, such that said bellows compresses and expands responding to changes in the exterior/interior pressure differential;

(b) a plunger comprising an axially-movable shaft, which is mounted in said interior transversely to said inner surface, and an end of which engages said inner surface on compression of said bellows; and (c) a switch assembly that actuates from a first to a second mode and means for actuating said switch assembly in a delayed, snapping manner upon axial movement of said plunger caused by compression of said bellows, which means returns said switch assembly to the first mode in a delayed, snapping manner upon subsequent expansion of said bellows, and comprising a base;

a projection projecting from said base;

a pair of contacts;

a third contact;

a movable piece, one end of which is engaged to said projection and the other end of which is movable with respect to said contacts;

a biasing spring assembly which gives said movable piece snap action and hysteresis action;

said biasing spring assembly comprising a first spring member cut out from said movable piece and a second separate spring member;

a free end of said first spring member being engaged to an engagement groove formed in one side of said third contact;

said second spring member being interposed, in an arcuately curved and stressed state, between an engagement groove formed on the other side of said third contact and an engagement projection formed on said movable piece; and an end of said plunger being coupled to said movable piece.

15. A pressure sensitive switch comprising:

(a) a longitudinally-compressible bellows, having an interior and an exterior, a corrosion-resistant coating on its exterior surface, a hollow, cylindrical body disposed about a longitudinal axis, a closed end portion of said body defining an outer, pressure-receiving surface and an inner surface, and an open end portion of said body fixed to a casing such that said bellows compresses and expands responding to changes in the exterior/interior pressure differential;

(b) a plunger comprising an axially-movable shaft, which is mounted in said interior transversely to said inner surface, and an end of which engages said inner surface on compression of said bellows;

(c) a switch assembly in said casing that actuates from a first to a second mode and means for actuating said switch assembly in a delayed, snapping manner upon axial movement of said plunger caused by compression of said bellows, which means returns said switch assembly to the first mode in a delayed, snapping manner upon subsequent expansion of said bellows; and (d) said casing for said switch assembly having an upper portion projecting therefrom within said cylindrical body in the direction of said inner surface and providing a channel within which said axially-movable shaft is disposed;

wherein sad switch includes a retaining plate integrally molded with said casing.

* * * * *